US007645163B2

(12) United States Patent
Amidon

(10) Patent No.: US 7,645,163 B2
(45) **Date of Patent: *Jan. 12, 2010**

(54) STEP UP PIN FOR COAX CABLE CONNECTOR

(75) Inventor: Jeremy Amidon, Marcellus, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/059,313

(22) Filed: Mar. 31, 2008

(65) Prior Publication Data

US 2008/0182451 A1 Jul. 31, 2008

Related U.S. Application Data

(63) Continuation-in-part of application No. 11/520,346, filed on Sep. 13, 2006, now Pat. No. 7,351,099.

(51) Int. Cl.
*H01R 9/05* (2006.01)

(52) U.S. Cl. ..... 439/578

(58) Field of Classification Search ..... 439/578, 439/583–585

See application file for complete search history.

(56) References Cited

U.S. PATENT DOCUMENTS

| | | | | |
|---|---|---|---|---|
| 3,213,404 | A | 10/1965 | Hedstrom | |
| 4,613,199 | A | 9/1986 | McGeary | |
| 4,666,230 | A | 5/1987 | Gartzke | |
| 4,672,342 | A | 6/1987 | Gartzke | |
| 4,676,577 | A * | 6/1987 | Szegda | 439/584 |
| 4,923,412 | A * | 5/1990 | Morris | 439/578 |
| 4,957,454 | A | 9/1990 | Shichida | |
| 4,981,445 | A | 1/1991 | Bacher et al. | |
| 5,137,471 | A * | 8/1992 | Verespej et al. | 439/585 |
| 5,217,391 | A | 6/1993 | Fisher, Jr. | |
| 5,498,175 | A | 3/1996 | Yeh et al. | |
| 5,769,662 | A | 6/1998 | Stabile et al. | |
| 5,957,724 | A | 9/1999 | Lester | |
| 6,159,046 | A * | 12/2000 | Wong | 439/578 |
| 6,863,565 | B1 | 3/2005 | Kogan et al. | |
| 7,053,750 | B2 | 5/2006 | Dascher | |
| 7,144,272 | B1 | 12/2006 | Burris et al. | |
| 7,153,159 | B2 | 12/2006 | Burris et al. | |
| 2002/0182934 | A1 * | 12/2002 | Endo et al. | 439/578 |
| 2003/0143887 | A1 | 7/2003 | Rehmann et al. | |
| 2005/0176292 | A1 | 8/2005 | Lee et al. | |
| 2005/0233636 | A1 | 10/2005 | Rodrigues et al. | |
| 2005/0277330 | A1 | 12/2005 | Kisling et al. | |
| 2006/0014425 | A1 | 1/2006 | Montena | |

FOREIGN PATENT DOCUMENTS

| | | |
|---|---|---|
| FR | 2 570 227 | 3/1986 |
| GB | 2 264 400 | 8/1993 |

* cited by examiner

*Primary Examiner*—Tho D Ta
(74) *Attorney, Agent, or Firm*—Hiscock & Barclay, LLP

(57) ABSTRACT

The invention provides a coaxial cable connector having a step up pin that engages the center conductor of a coax cable to increase the diameter of the center conductor to thereby make it more manageable. The pin is stored with the connector until the pin and connector are affixed to a coax cable.

19 Claims, 20 Drawing Sheets

STEP UP PIN FOR COAX CABLE CONNECTOR

CROSS-REFERENCE TO RELATED APPLICATIONS

This application is a Continuation-In-Part of U.S. patent application Ser. No. 11/520,346 filed Sep. 13, 2006, the disclosure of which is herein incorporated by reference.

FIELD OF THE INVENTION

This invention relates to coaxial cable connectors that engage the center conductor and the outer conductor of an end of a coaxial cable.

BACKGROUND OF THE INVENTION

A coax cable connector is generally used to provide a simple connection to an externally threaded coax receptacle or jack. The connector contacts the outer conductor of the cable in order to conduct the outer conductor signal to the jack. The center conductor of the cable passes through the center of the connector to engage the center hole of the jack. A dielectric portion between the components of the connector that contact the center conductor and the outer conductor isolates the signals. In some cases, such as with miniature coaxial cable, the center conductor is too small to engage the center hole of the jack fully for good conduction of the center conductor signal. A step up pin may be applied to the end of the center conductor to increase the diameter of the center conductor; however, step up pins are conventionally difficult to manage, are easily lost, and may be difficult to apply to the center conductor. Further, step up pins tend to be easily damaged during handling. In some cases, the pin might be a fixed part of the connector. It is difficult to line up the center conductor of the coax cable with the pin in this case because the user cannot see the opening of the axial bore of the pin.

A number of U.S. patents are directed to coax cable connectors including U.S. Pat. No. 4,613,199 issued to McGeary. McGeary teaches a coaxial cable connector having a captive inner pin contact. The connector includes a tubular main body that is crimped over the cable braid of a coaxial cable. A crimp ring is provided inside the rear end of the tubular main body and secures the cable braid of the coaxial cable against a ferrule which is inserted between the cable braid and the cable dielectric prior to crimping. A cylindrical contact insulator is secured inside the front end of the tubular main body, separates the inner pin contact from the front end of the tubular main body, and secures the inner pin contact in combination with the insulator ring and ferrule. Threads are provided on the inside surface of the ferrule to hold the ferrule in position during crimping, to help provide positive contact to the tubular main body, and to captivate the insulator ring and inner pin contact. McGeary does not teach how the pin might be stored prior to assembly of the connector onto a cable. Nor does McGeary teach a step up pin having tabs or spring fingers for engaging the connector or the center conductor.

U.S. Pat. No. 6,863,565 issued to Kogan, et al. teaches a connector for receiving a mating plug, forming a constant impedance connection. The center conductor of the first plug is supported with a cap attached over a portion of the center conductor that extends beyond the outer conductor portion of the same plug. The mating plug has an outer conductor that projects beyond the inner conductor, and is made to receive the connector or first plug portions. Kogan thus teaches a pin having a larger diameter than the center conductor and supporting the center conductor. Kogan does not discuss securing the pin to the connector prior to assembly in a way that prevents the pin from being lost and that aids assembly of the pin onto the center conductor. Kogan further does not teach a step up pin with an enlarged cable guide portion or spring fingers and tabs for engaging the center conductor or the connector.

U.S. Pat. No. 4,981,445 issued to Bacher, et al. teaches a unitary three-vane support bead with a central conductor having an axial blind bore in each end. The smaller diameter end engages a center conductor of a coax cable. The central conductor is formed in place in the connector. Bacher does not teach a method of securing the pin to the connector prior to assembly in a way that prevents the pin from being lost and that aids assembly of the pin onto the center conductor.

U.S. Pat. No. 4,672,342 issued to Gartzke teaches a coaxial cable connector assembly for connecting coaxial cables of different diameters, the assembly including a center conductor with a large diameter end and a small diameter end. Each end includes spring fingers for engaging the center conductor of a coaxial cable. Gartzke does not discuss securing the pin to the connector prior to assembly in a way that prevents the pin from being lost and that aids assembly of the pin onto the center conductor.

Therefore, a coaxial cable connector that provides storage and protection for a step up pin, and that provides a simple way to apply the step up pin to the center conductor is desired.

SUMMARY OF THE INVENTION

The invention comprises, in one form, a step up pin for increasing the diameter of a coaxial cable's center conductor. In certain embodiments, the step up pin is used in conjunction with a coaxial cable connector. The step up pin includes a blind bore sized for a tight fit with the center conductor to provide good conduction between the center conductor and the pin. The pin further includes an enlarged cable guide. The pin is stored with the connector until the pin and connector are affixed to a coax cable.

More particularly, the invention includes a coaxial cable connector that comprises a connector body having a collar with a nut body engaging one end of the collar; a non-conducting pin guide situated within the connector body proximate to the junction between the nut body and the collar; and a step up pin comprising a pin body and a cable guide. The pin guide defines a through bore, and the step up pin is removably engaged with the through bore of the pin guide with the cable guide situated within the nut body and with the step up pin directed toward the opposing end of the collar.

In another form, the invention includes a coaxial cable connector that comprises a connector body defining an axial bore for engaging a coaxial cable; a compressor ring defining a sidewall bore with an enlarged recessed portion, the compressor ring operatively attached to the connector body; and a step up pin having a cable guide and defining a blind bore for engaging a center conductor of a coaxial cable. The step up pin is removably engaged to the sidewall bore with the cable guide situated at least partially within the recessed portion prior to the coaxial cable being inserted into the axial bore of the connector.

The invention allows the pin to be stored with the connector so that the pin is not easily dropped or lost and such that the pin is easily attached to even small diameter center conductors. Further, because the pin is not fixed within the body of the connector with the opening of the pin hidden within the connector, the user can easily see the opening of the pin for lining up the center conductor.

BRIEF DESCRIPTION OF THE DRAWINGS

The present invention is disclosed with reference to the accompanying drawings, wherein.

Corresponding reference characters indicate corresponding parts throughout the several views. The examples set out herein illustrate several embodiments of the invention but should not be construed as limiting the scope of the invention in any manner.

DETAILED DESCRIPTION

Figure 1:
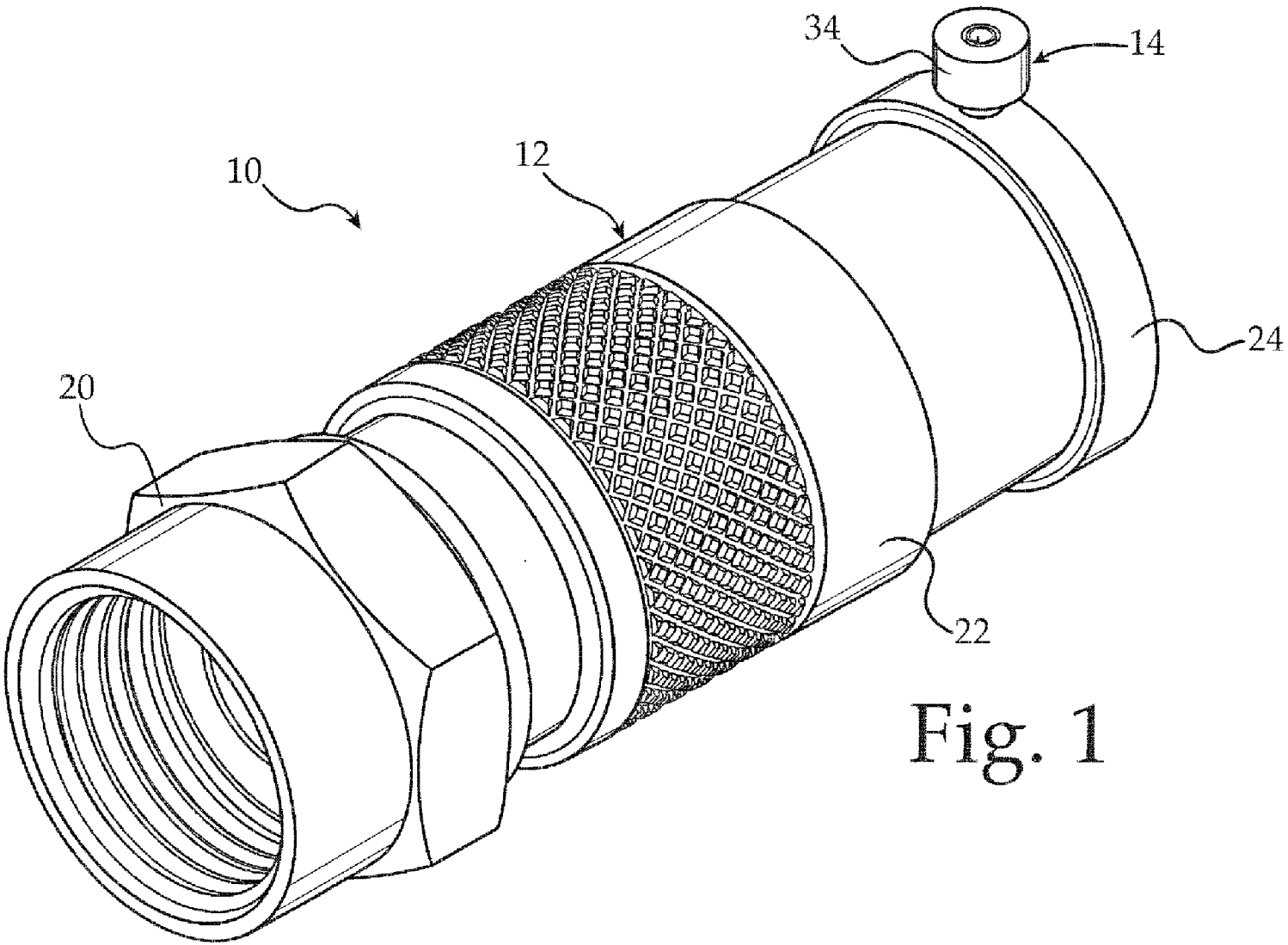
FIG. 1 is an isometric view of a coax cable connector according to the present invention.
Figure 2:
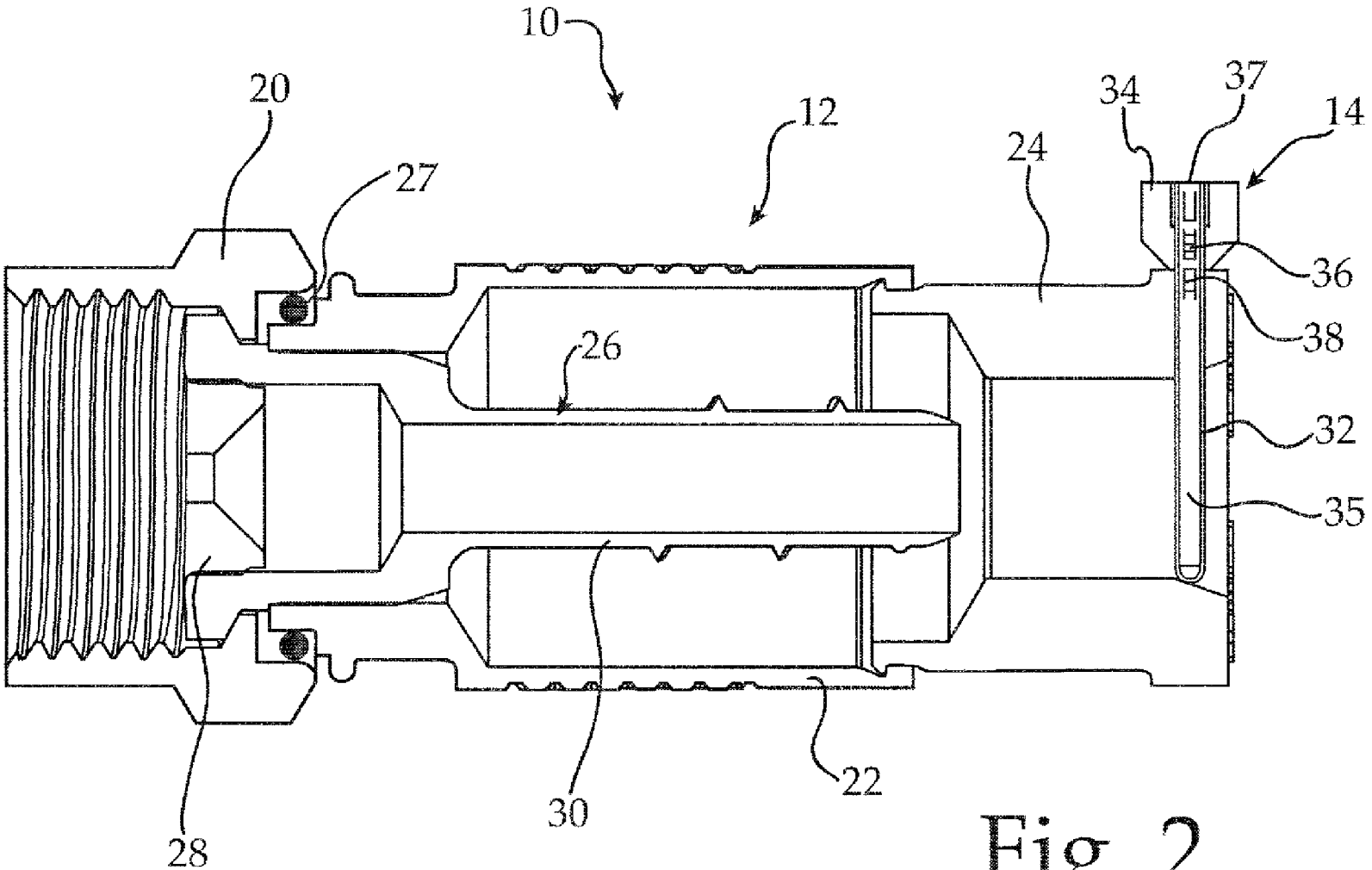
FIG. 2 is a cross-sectional view of the coax cable connector of FIG. 1.

FIG. 1 shows the coax cable connector of the present invention. The connector 10 includes a connector body 12 and a step up pin 14. The connector body 12 includes a nut body 20, a collar 22, a compression ring 24, and an inner post 26 (see FIG. 2). The nut body 20 includes internal threads for connection to an externally threaded coax jack (not shown). The nut body 20 contacts the inner post 26 for electrical connection and engages the collar 22 via an o-ring 27. The collar 22 is knurled or otherwise textured to provide an improved grip on the collar. In its pre-use or storage position, the compression ring 24 is clipped into the end of the collar 22 as shown in FIG. 2. The inner post 26 includes a pin guide 28 and a shaft 30 with barbs for engaging the coax cable's dielectric sleeve.

Figure 3A:
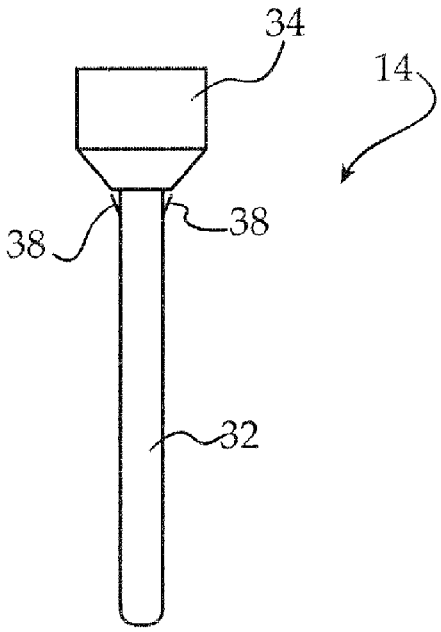
FIGS. 3A-3C are views of the step up pin according to the present invention.
Figure 3B:
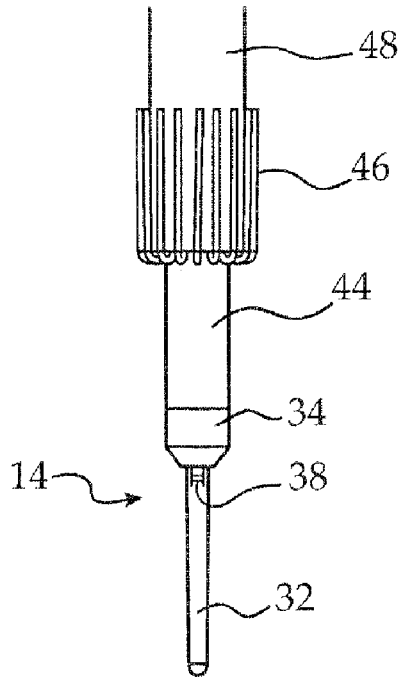
Figure 3C:
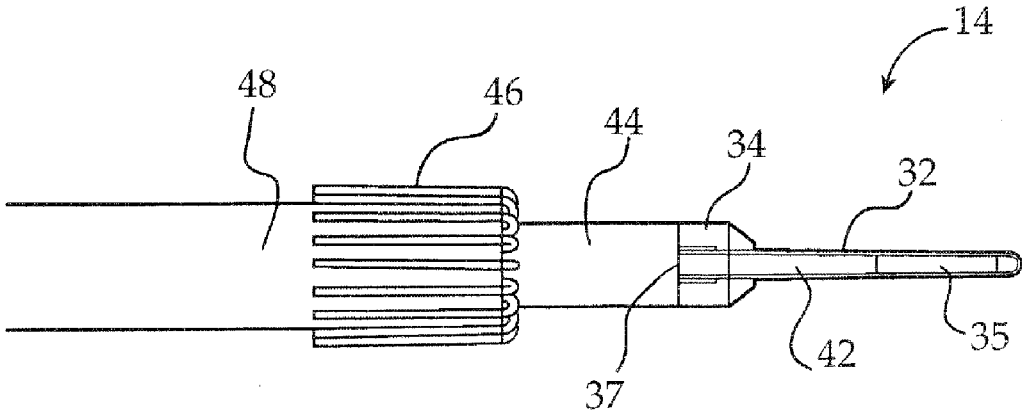

The step up pin 14, which may be used in conjunction with the connector 10 or with any application requiring the increased diameter of the center conductor, includes a pin body 32 and a cable guide 34. The pin body 32, best shown in FIGS. 2 and 3A, includes an axial bore 35 sized for a snug fit with the center conductor of a coax cable. Spring fingers 36 may be included to secure the center conductor within the bore and to improve the conduction between the center conductor and the step up pin 14. The spring fingers 36 project into the pin body 32 and are directed away from the bore opening. As shown, the axial bore 35 is a blind bore with an open end 37. Tabs 38 project outward from the pin body 32, toward the opening of the bore. The cable guide 34 is either integrally formed with the pin body 32 or affixed thereto, such as by an interference fit or an adhesive. The cable guide 34 is complementarily contoured to fit into the slope of the pin guide 28. The outward bias of the tabs 38 assists in retaining the step up pin 14 within the pin guide 28. The step up pin 14 is applied to a coax cable 40 as shown in FIGS. 3A and 3B.

Figure 4A:
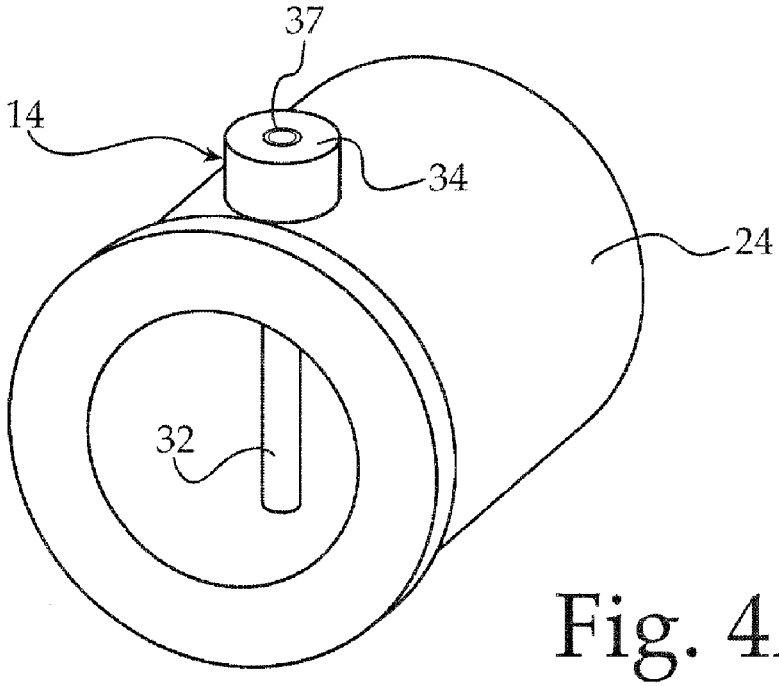
FIG. 4A is an isometric view of the compression ring and step up pin of FIG. 1.
Figure 4B:
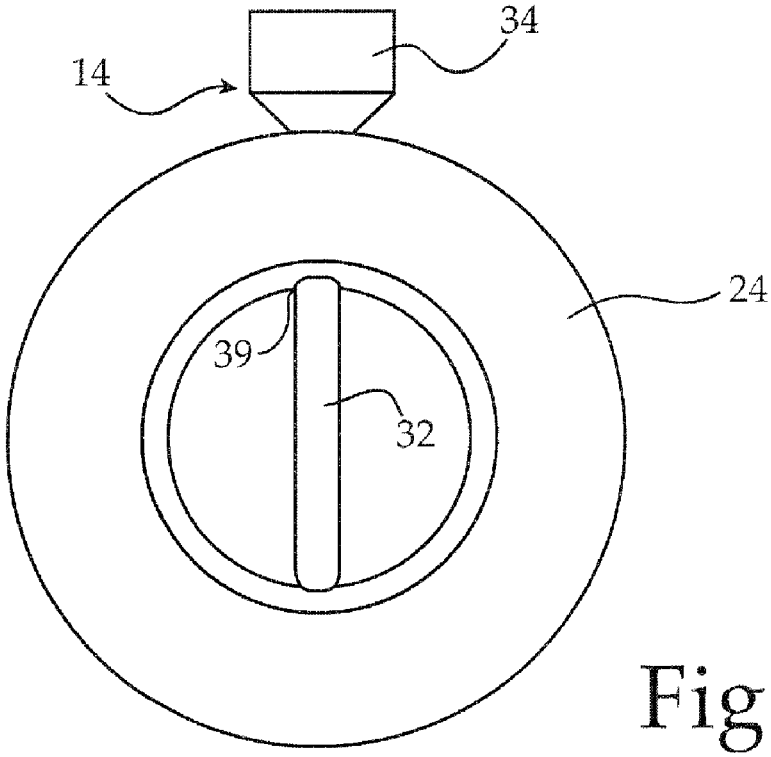
FIG. 4B is an end view of the compression ring and step up pin of FIG. 4A.

As shown in FIGS. 4A and 4B, a sidewall bore 39 is either machined or molded into the compression ring 24 for the storage of the step up pin 14 prior to assembly. The sidewall bore 39 is configured for a snug fit with the pin body 32 to prevent the pin 14 from being separated from the connector body 12. Also, the outward bias of the tabs 38 resists separation of the step up pin 14 and the sidewall bore 39.

Figure 5A:
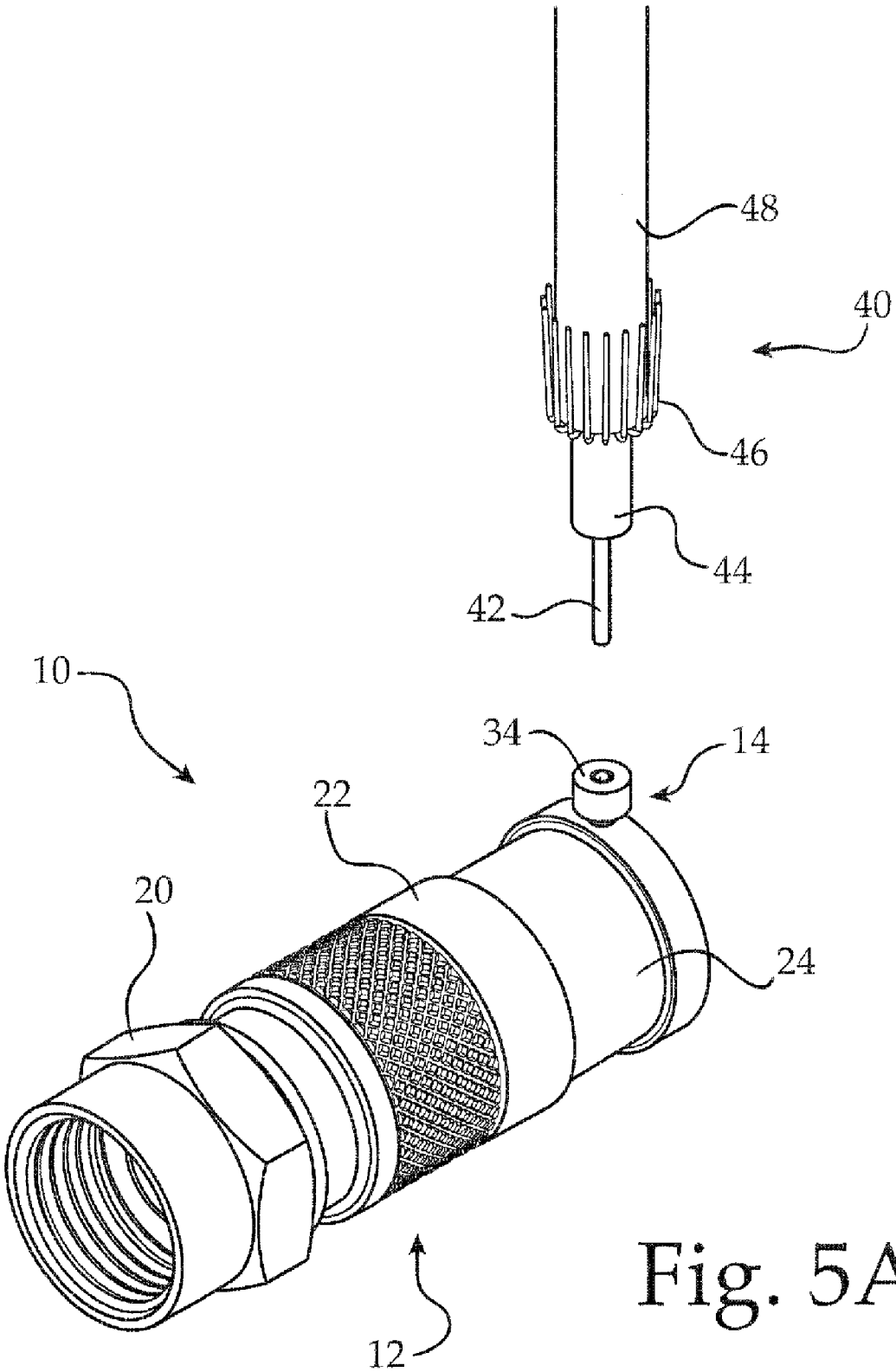
FIGS. 5A-5E are various views of the application of the step up pin and the coax cable connector of FIG. 1 onto a coax cable.
Figure 5B:
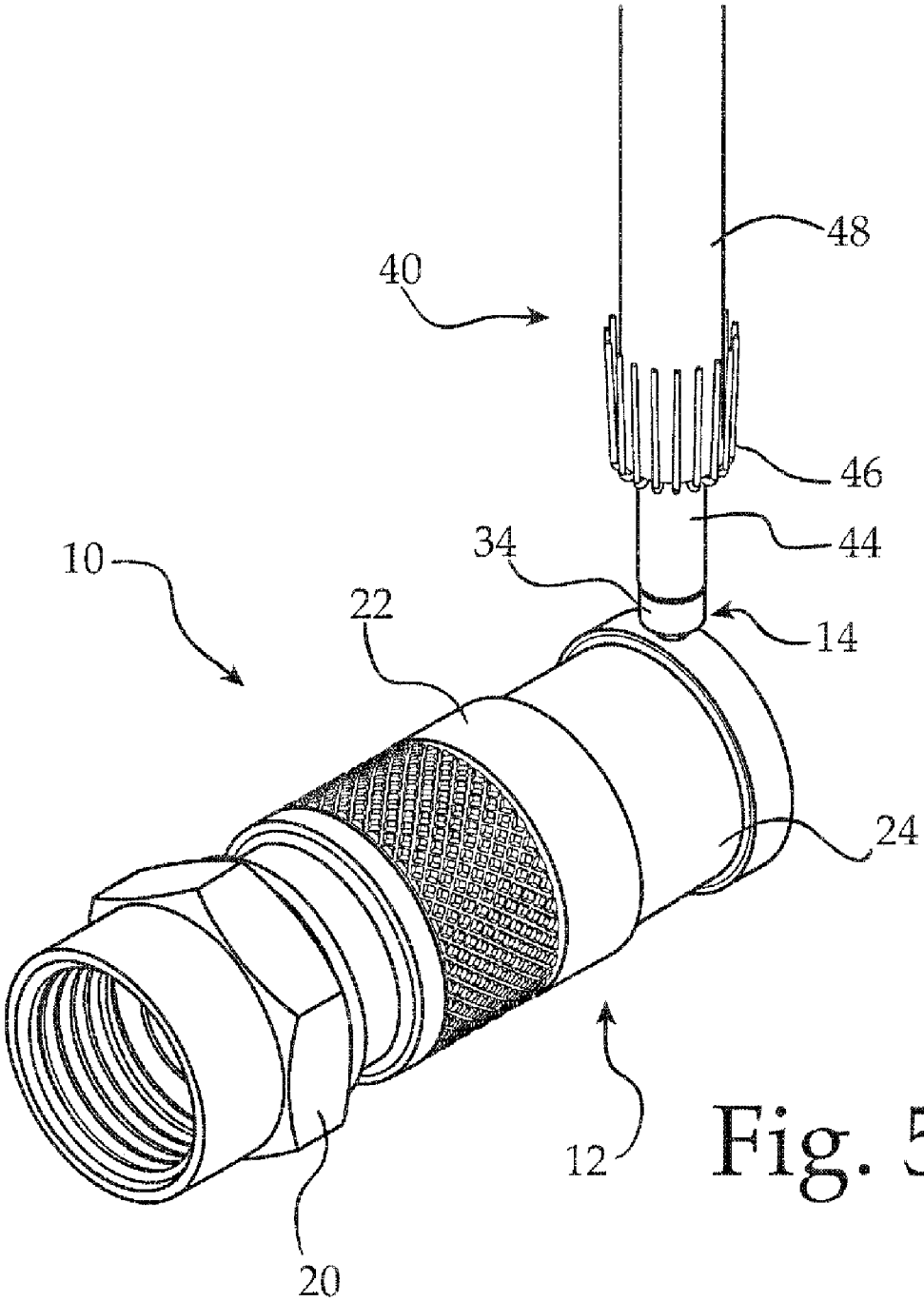
Figure 5C:
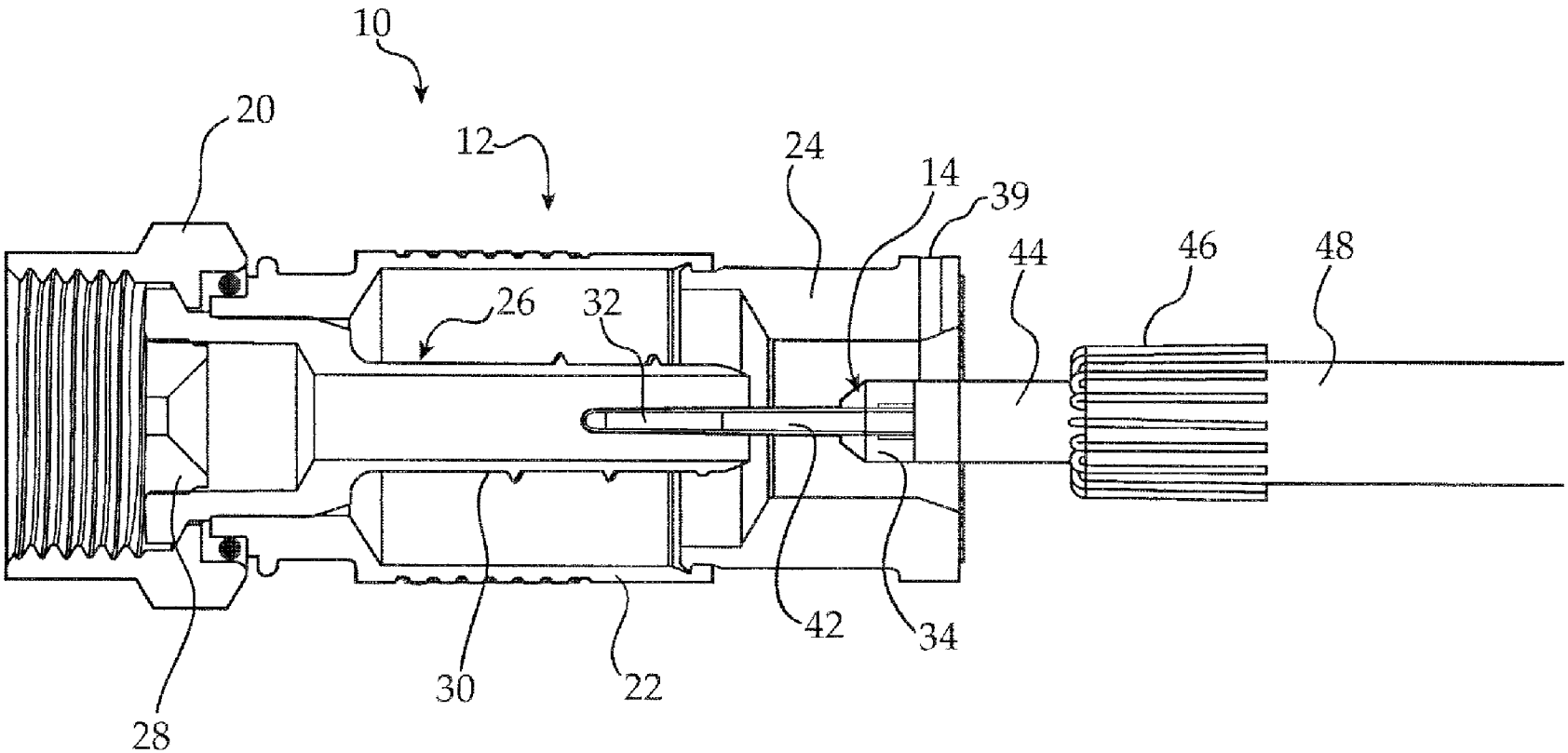

The connector 10 is assembled onto a coax cable as shown in FIGS. 5A-5E. With reference to FIG. 5A, the coax cable 40 is of a known type comprising an electrical central conductor 42, a dielectric sleeve 44, an outer conductor 46, and a jacket 48. The outer conductor 46 may comprise a sheath of fine braided metallic strands, a metallic foil, or multiple layer combinations of either or both. The cable 40 is prepared as usual, such as by exposing about 0.25-in of the center conductor 42 and about 0.25-in of the dielectric sleeve 44 and outer conductor 46 above that. The outer conductor 46 is folded back over the jacket 48. The user inserts the center conductor 42 into the axial bore of the pin body 32 as shown in FIG. 5B. The user then withdraws the cable 40 with the step up pin 14 from the sidewall bore 39 of the compression ring 24 and inserts the cable 40 and step up pin 14 into the axial bore of the compression ring 24 as shown in FIG. 5C.

Figure 5D:
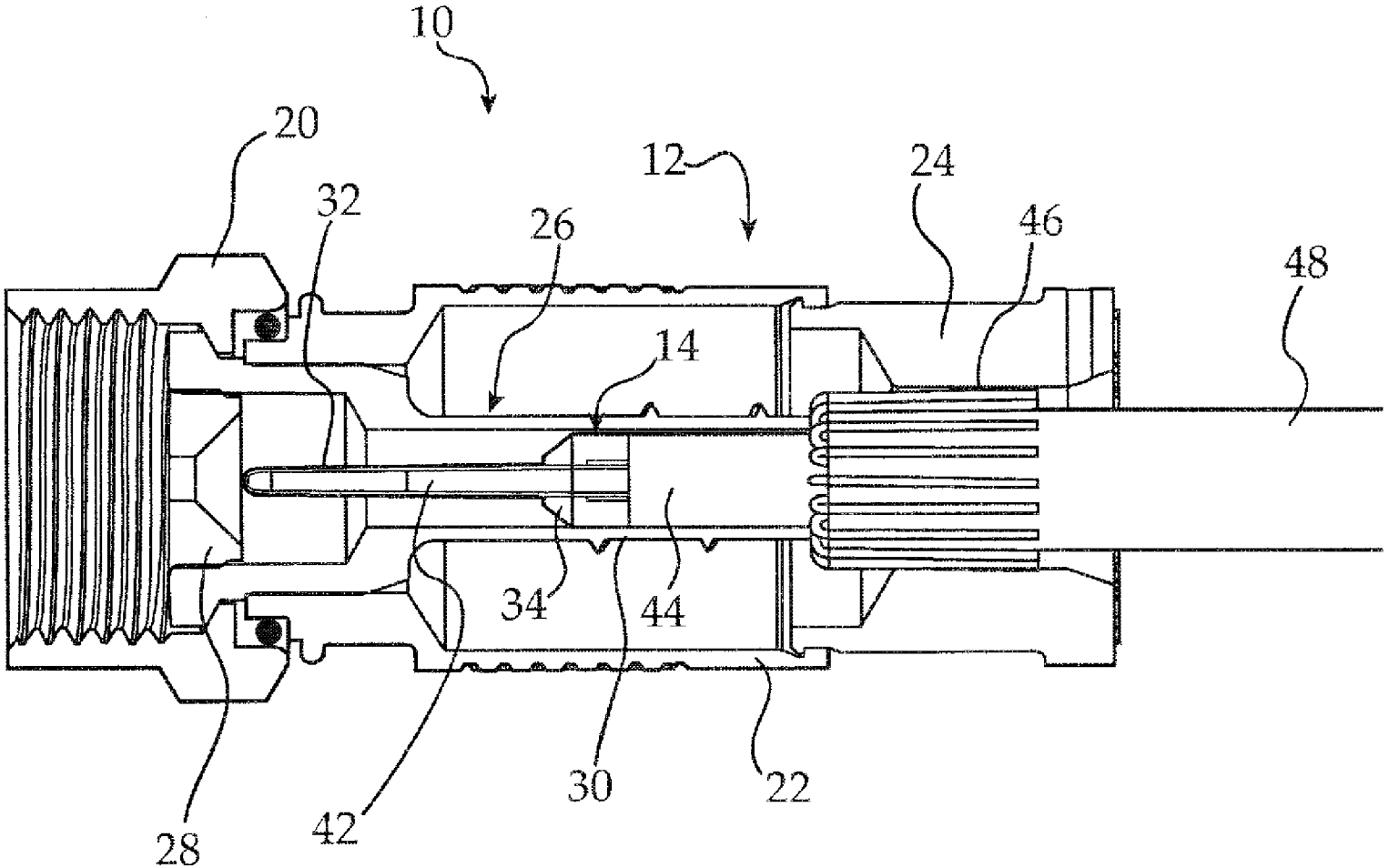
Figure 5E:
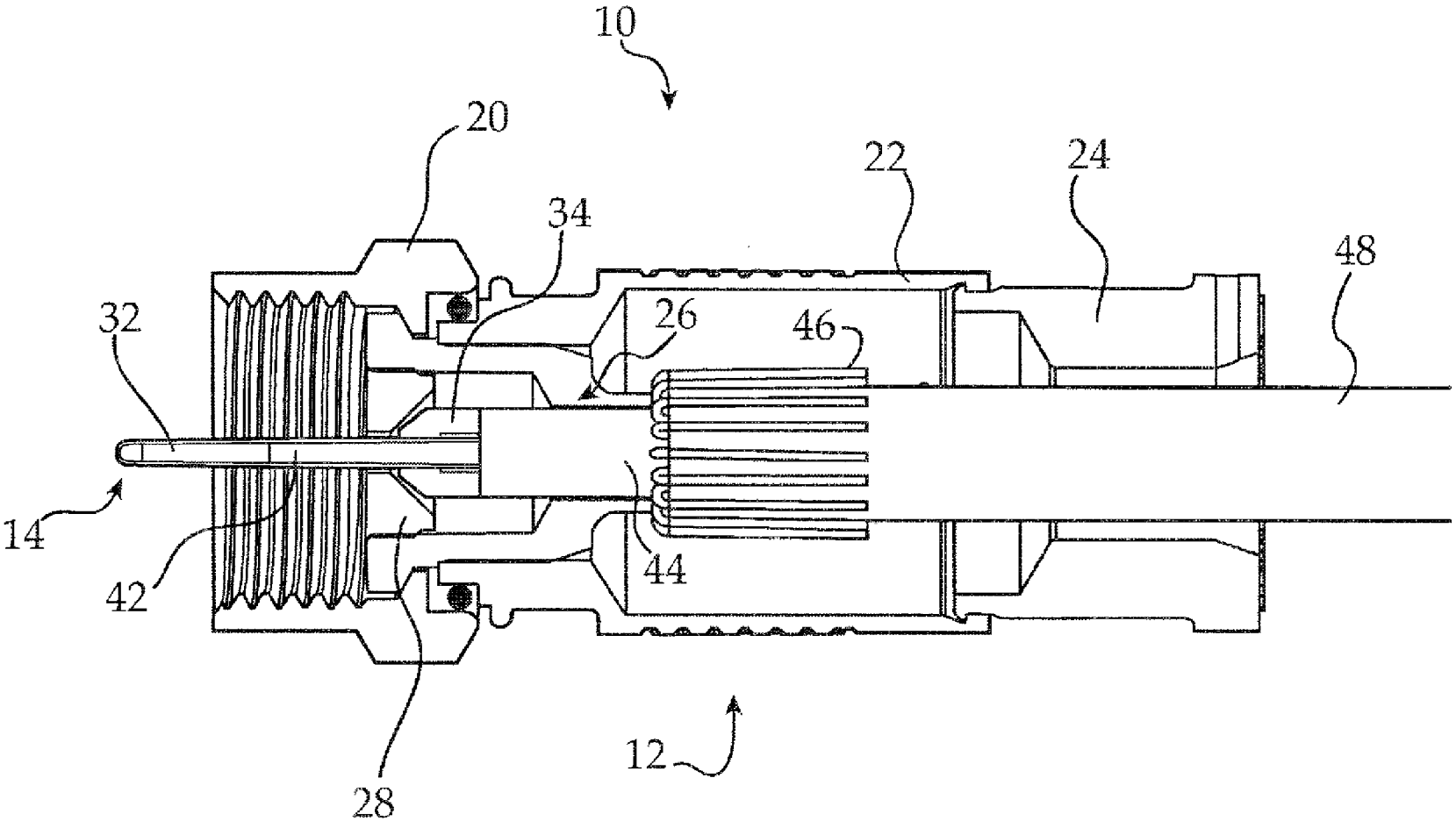

The step up pin 14 and the dielectric sleeve 44 are inserted into the axial bore of the inner post 26 such that the shaft 30 is forced in between the dielectric sleeve 44 and the outer conductor 46 as shown in FIG. 5D. The user continues to direct the cable 40 into the connector body 12 until the cable guide 34 engages the pin guide 28 as shown in FIG. 5E. A compression tool (not shown) forces the compression ring 24 into the collar 22 such that the compression ring 24 compresses the jacket 48 and the outer conductor 46 against the shaft 30 to secure the cable 40 within the connector 10 and to provide good conduction between the outer conductor 46 and the inner post 26.

In uses the connector 10 is attached to a coaxial cable jack (not shown) by inserting the step up pin 14 into an axial bore of the jack and threading the internal threads of the nut body 20 onto corresponding external threads of the jack. An electrical signal is conducted between the center conductor of the jack and the center conductor 42 via the pin body 32. An electrical signal is conducted from the threaded outer conductor of the jack to the nut body 20 and the end of the inner post 26. The inner post 26 conducts the signal to the outer conductor 46. The non-conducting pin guide 28 isolates the inner conductor signal from the outer conductor signal within the connector 10. The cable guide 34 may also be non-conducting.

Figure 6A:
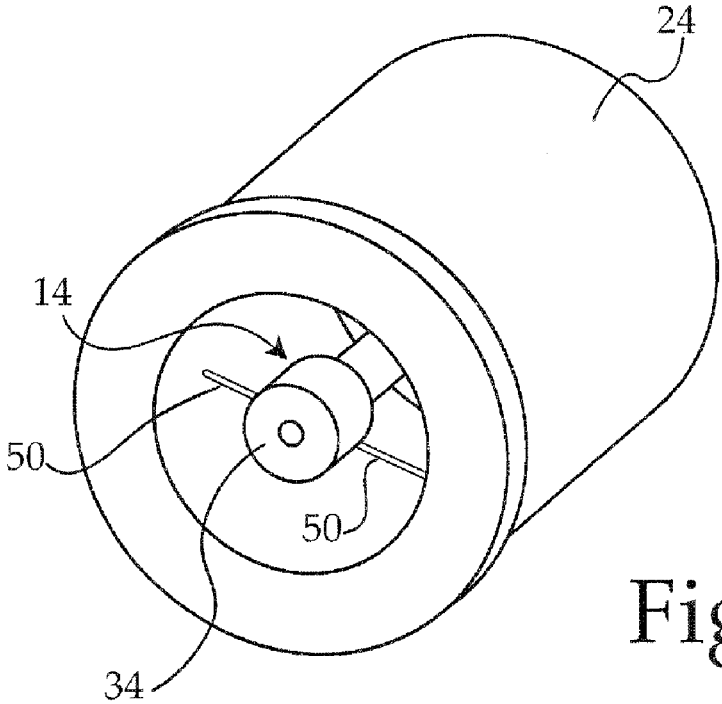
FIG. 6A is an isometric view of the compression ring and step up pin of a second embodiment of the coax cable connector of the present invention.
Figure 6B:
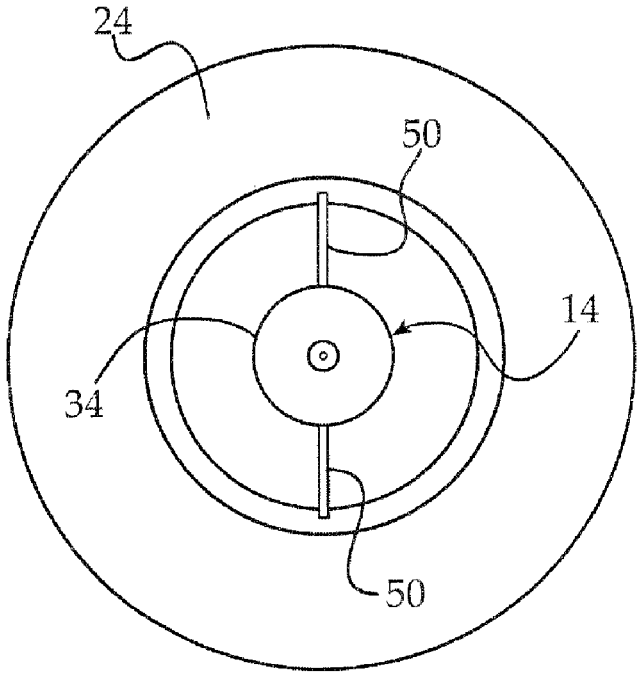
FIG. 6B is an end view of the compression ring and step up pin of FIG. 6A.

In an alternative embodiment, the step up pin 14 is stored in a concentric position within the compression ring 24 as shown in FIGS. 6A and 6B. The step up pin is held within the compression ring 24 by sprue tabs 50. The cable guide 24 is molded with the compression ring 24 with the sprue tabs 50 being formed therebetween. During assembly, the center conductor engages the bore of the ping body 32 and the cable is pushed into the connector body 12 thereby breaking the sprue tabs 50 and driving the step up in 14 to the pin guide 28.

Figure 7A:
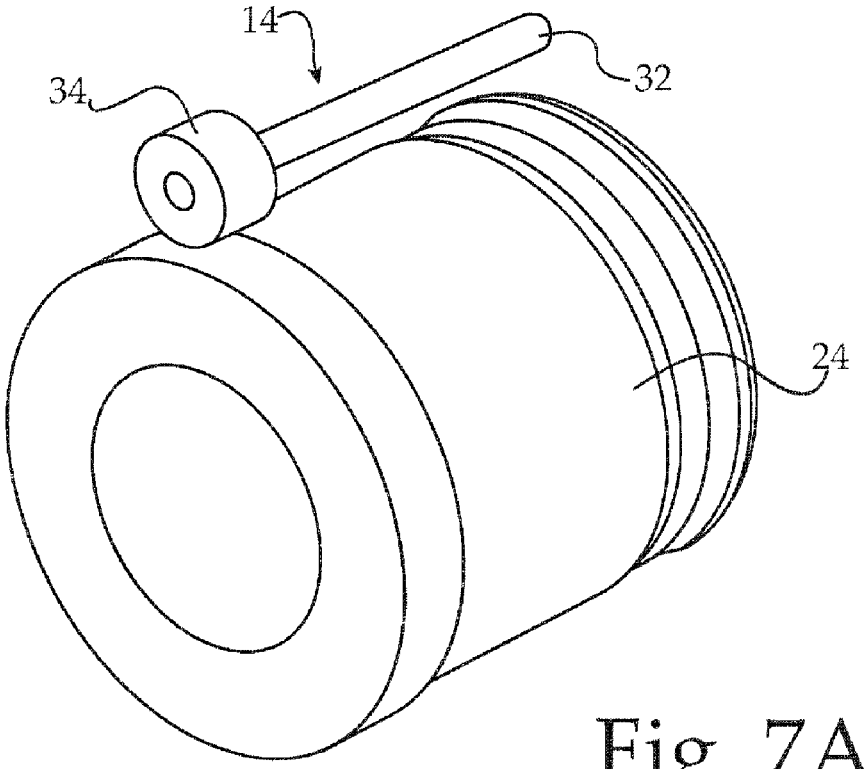
FIG. 7A is an isometric view of the compression ring and step up pin of a third embodiment of the coax cable connector of the present invention.
Figure 7B:
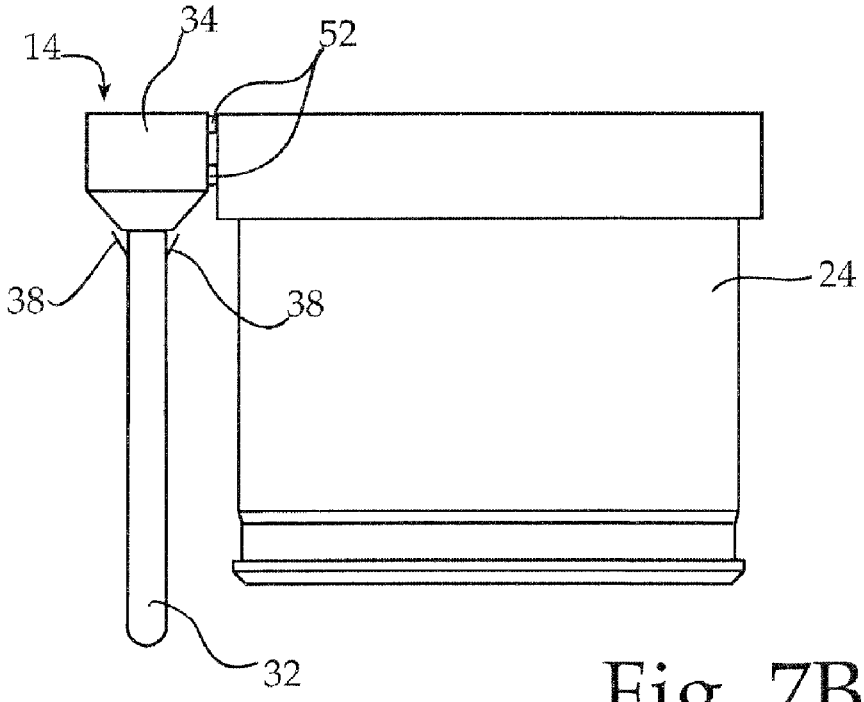
FIG. 7B is an end view of the compression ring and step up pin of FIG. 7A.

In a further alternative embodiment, the step up pin 14 is stored in engagement with the outer surface of the compression ring 24 as shown in FIGS. 7A and 7B. The cable guide 34 is molded with the compression ring 24 with sprue tabs 52 formed therebetween. The connector 10 is assembled onto a coax cable by inserting the center conductor into the bore of the pin body 32 and twisting the step up pin 14 to break the sprue tabs 52 and remove the cable guide 34 from the compression ring 24. The assembly is completed as described above with reference to FIGS. 5C-5E.

Figure 8A:
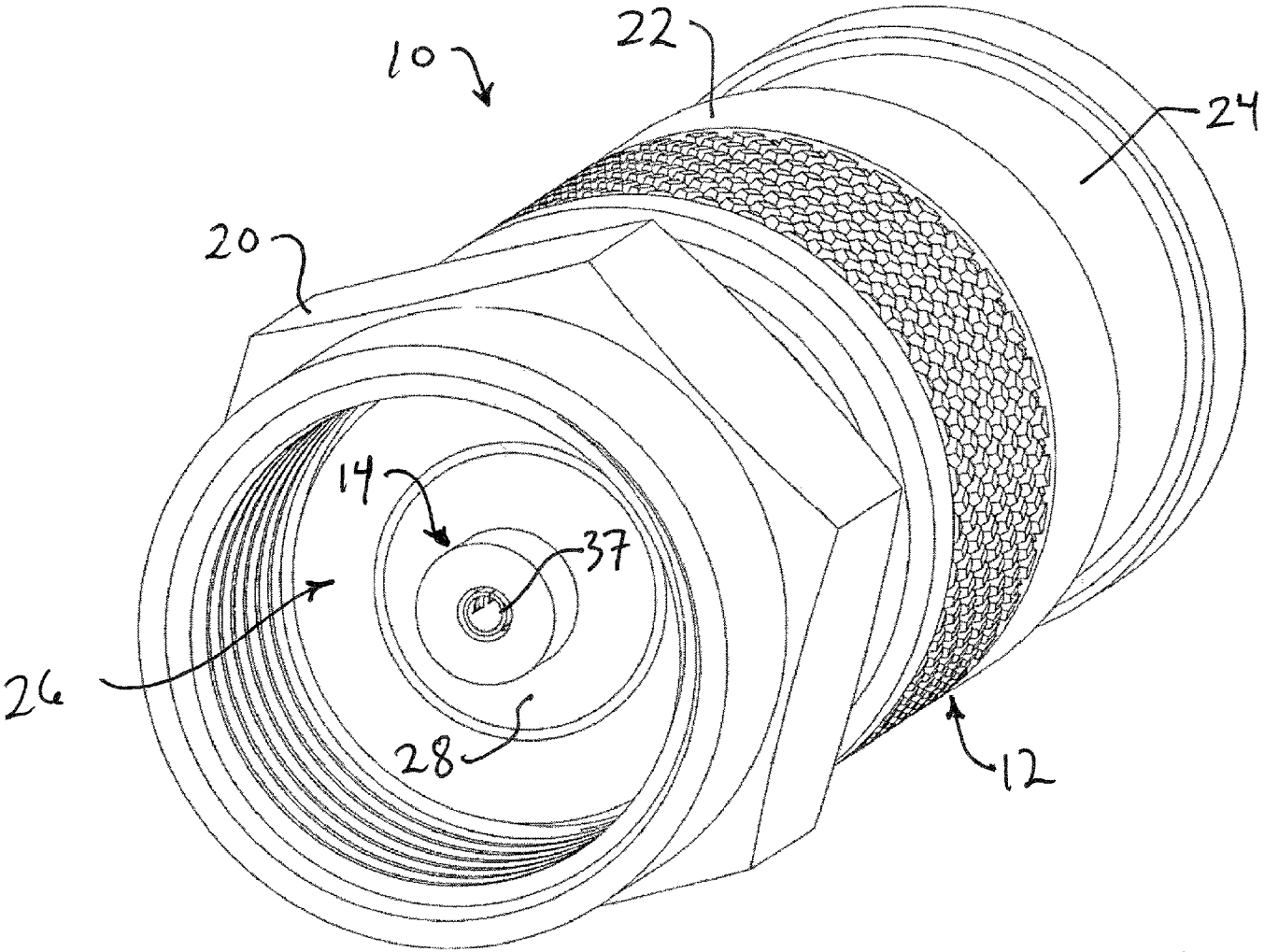
FIG. 8A is an isometric view of a particular embodiment of the coax cable connector with the step up pin stored in engagement with the pin guide.
Figure 8B:
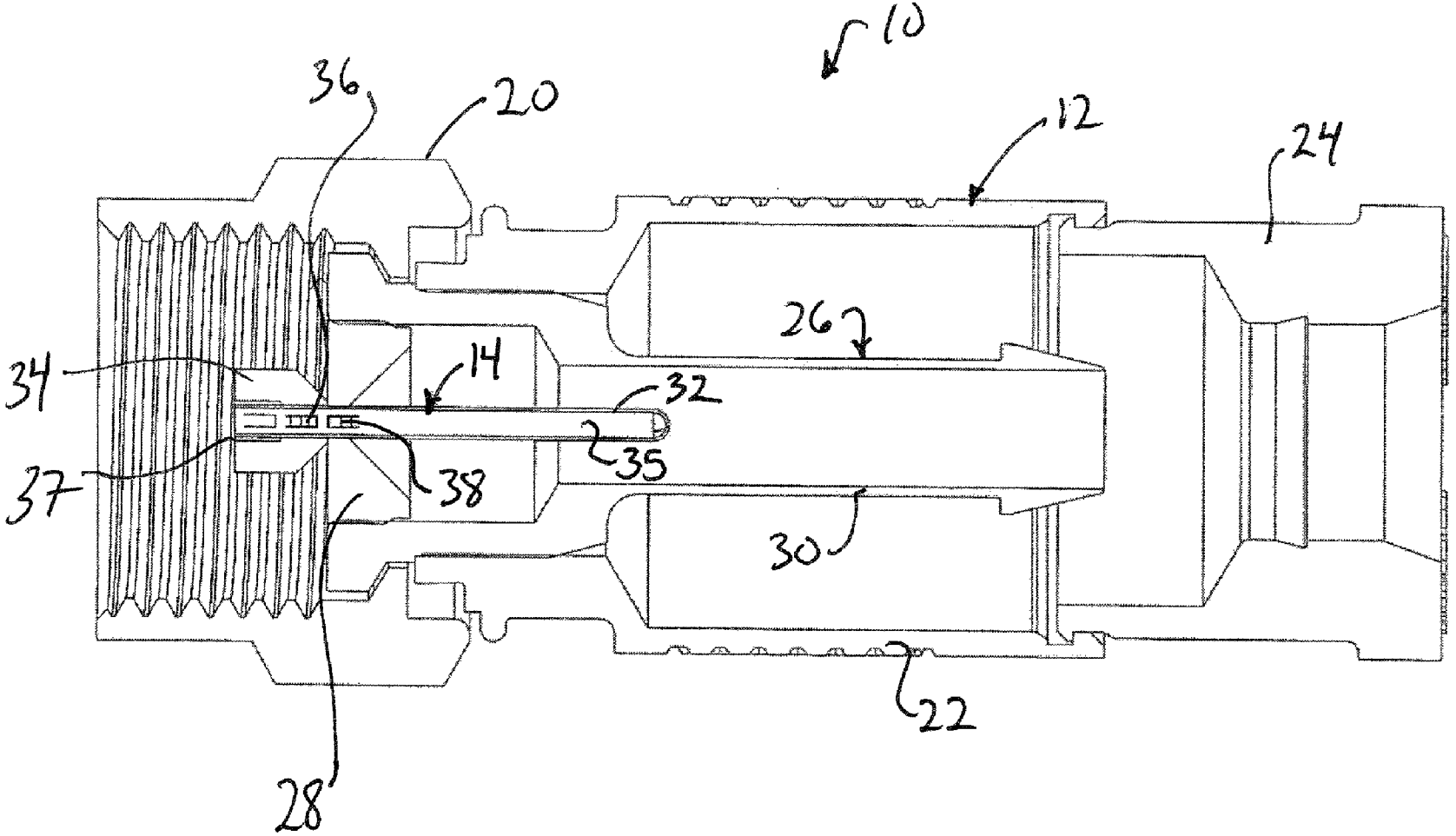
FIG. 8B is a cross-sectional side view of the coax cable connector of FIG. 8A.

In a particular embodiment shown in FIGS. 8A and 8B, the step up pin 14 is stored within the connector body 12 in a press-fit engagement with an axial through bore of the non-conducting pin guide 28. The step up pin 14 is inserted through the nut body 20 and into the pin guide 28 for storage within the connector body 12. The cable guide 34 is situated within the nut body 20 and the opening 37 of the blind bore 35 directed towards the opening of the nut body 20. The step up pin 14 is therefore directed towards the compressor ring end of the connector body 12. This has the advantage of providing easy access to the open end 37 of the blind bore 35 of the step up pin 14 when assembling the pin on the center conductor. The step up pin 14 is thus conveniently stored within the connector body 12, which protects the potentially fragile pin from damage during handling. The compression ring 24 does not require a sidewall bore or sprue tabs for retaining the step up pin before assembly.

Figure 9A:
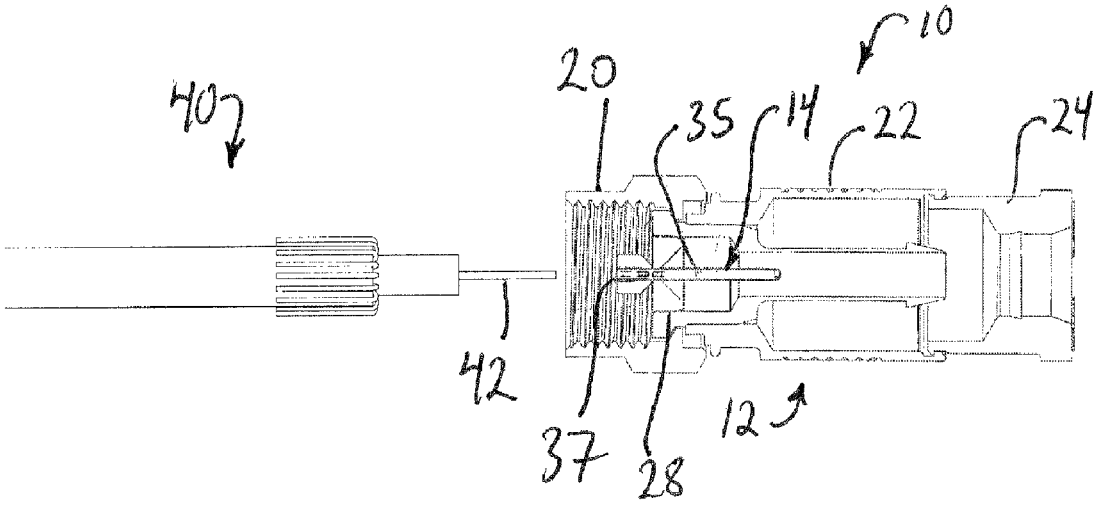
FIGS. 9A-9F are various views of the application of the step up pin and the coax cable connector of FIG. 8A onto a coax cable.
Figure 9B:
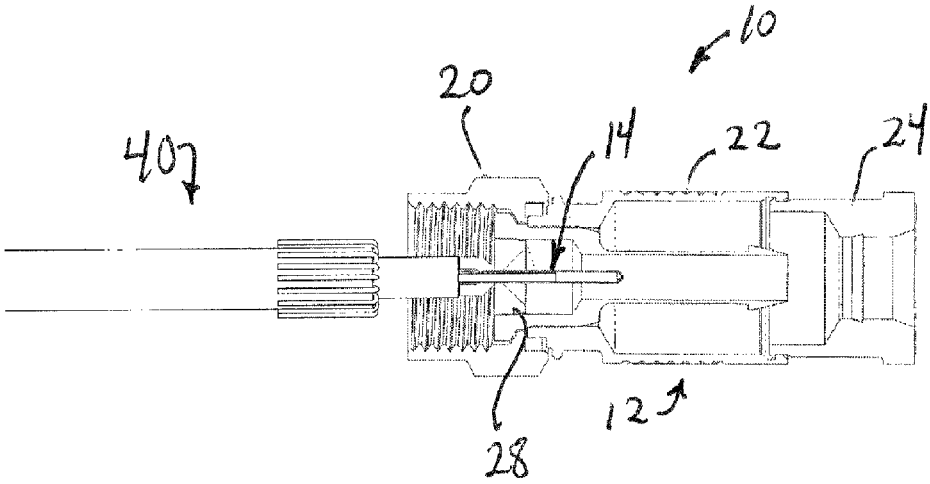
Figure 9C:
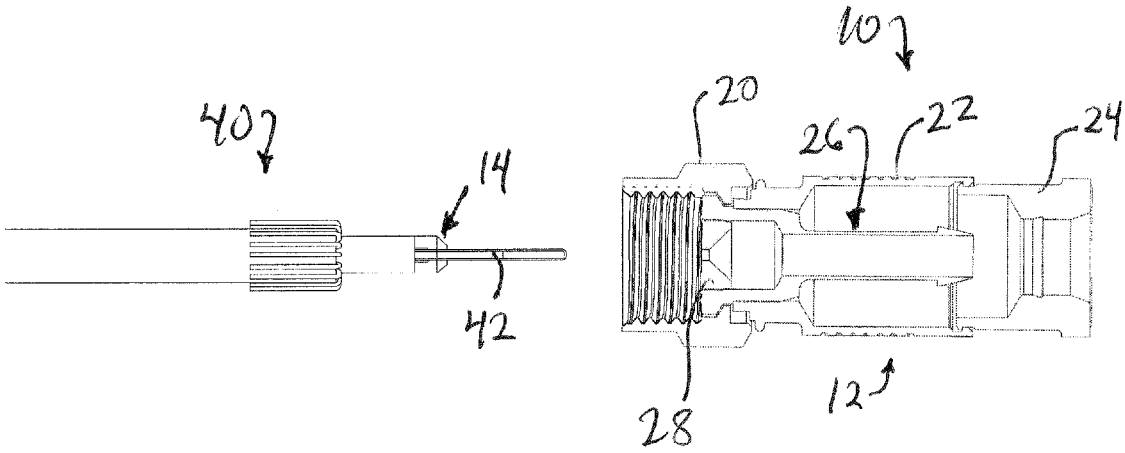
Figure 9D:
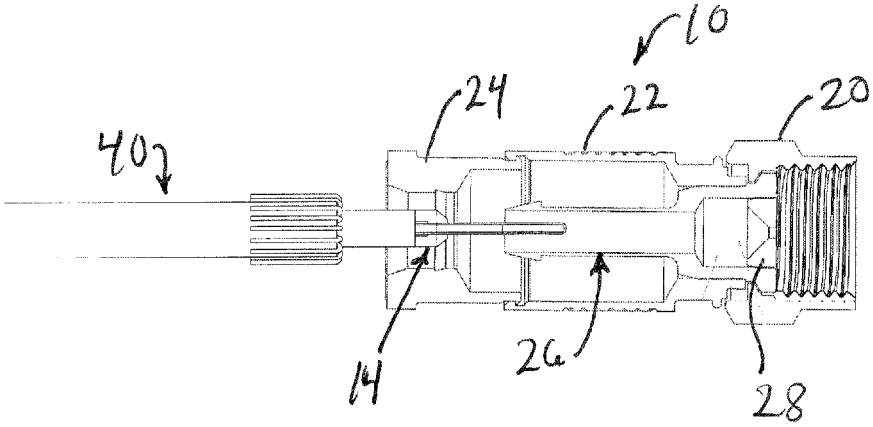
Figure 9E:
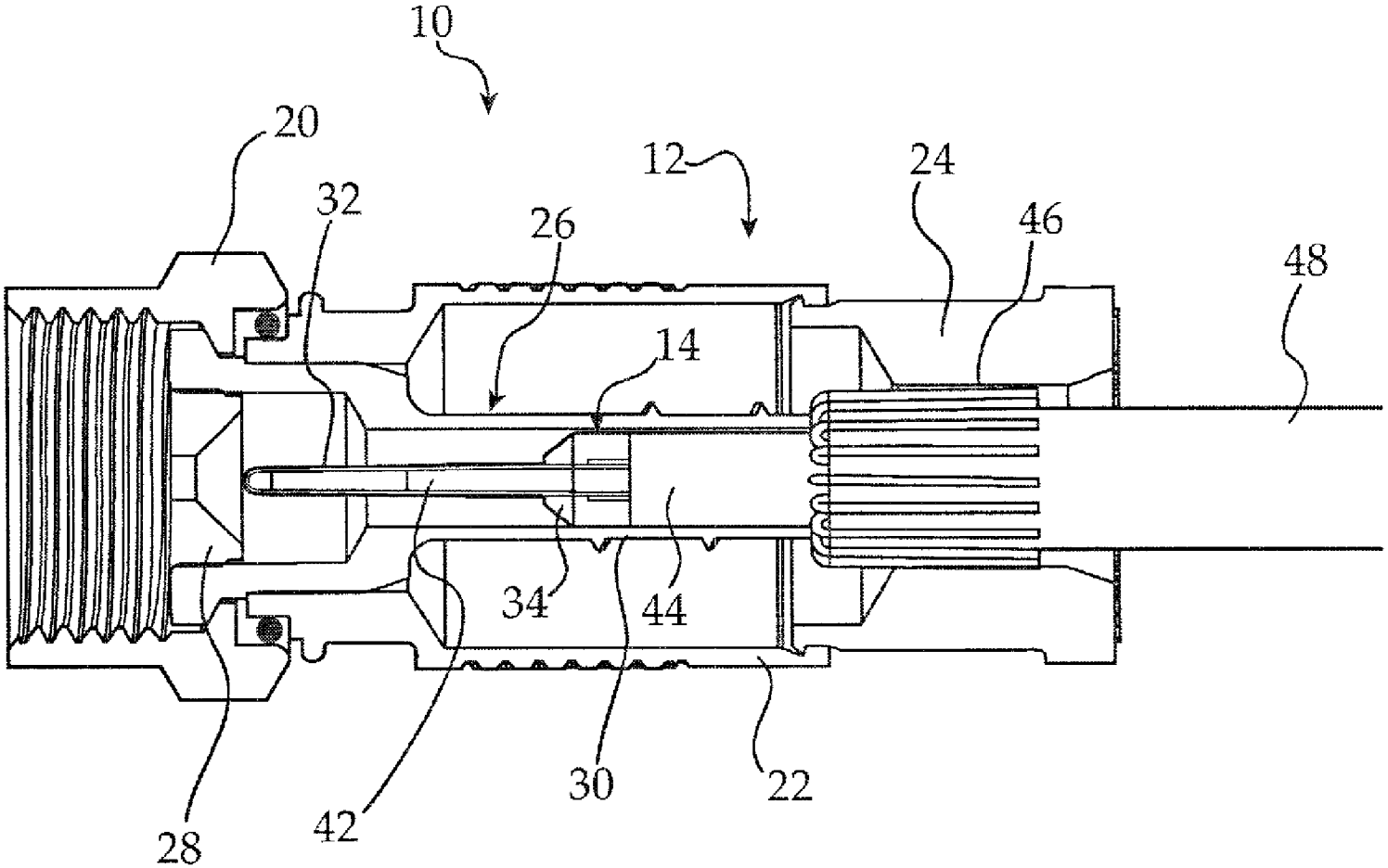
Figure 9F:
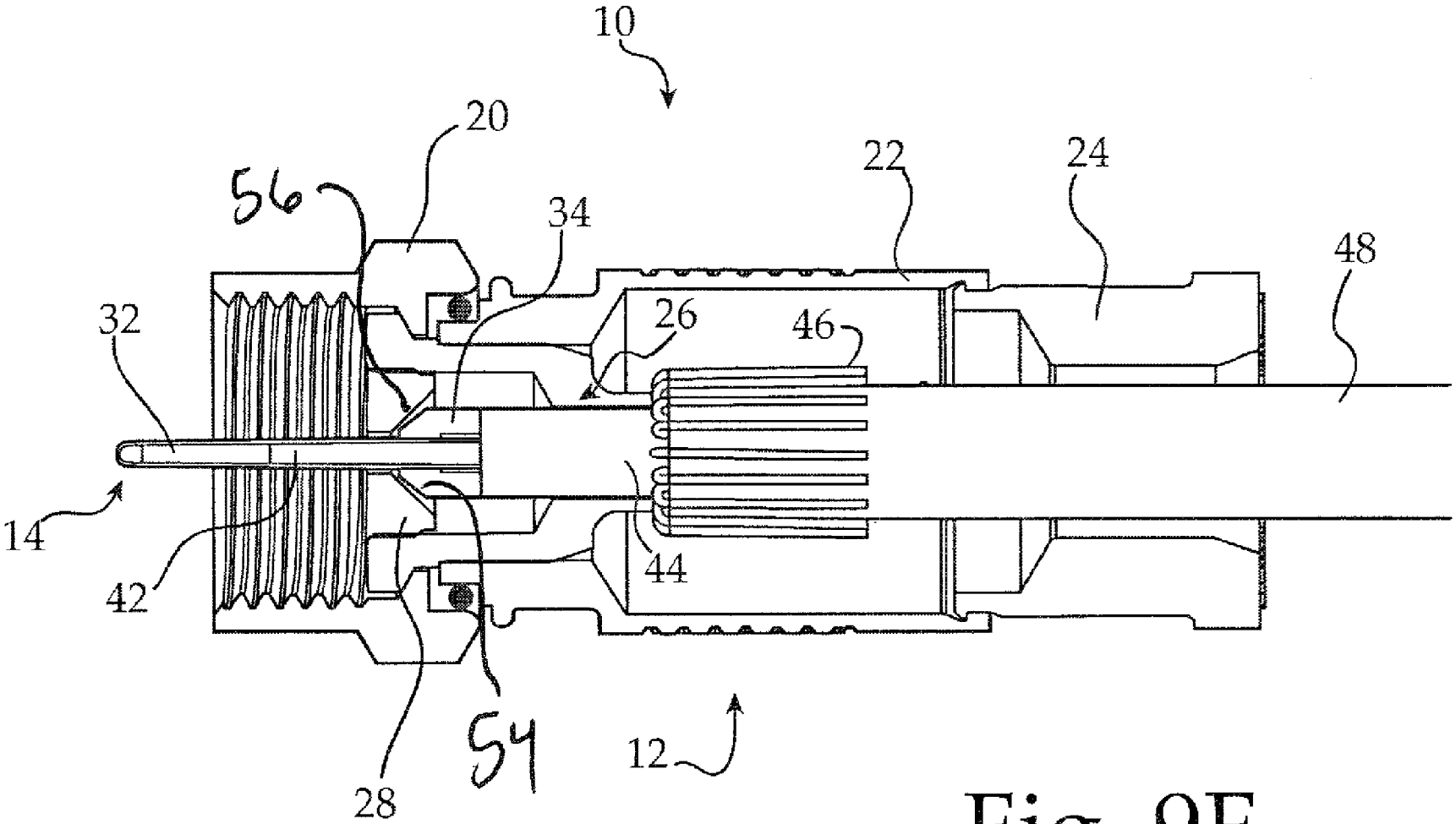

The connector 10 is assembled onto the prepared end of a coax cable 40 by inserting the center conductor 42 through the open end 37 of the axial blind bore 35 via the axial bore of the nut body 20 as shown in FIGS. 9A and 9B. The spring fingers 36 help secure the center conductor 42 within the axial blind bore 35. The user withdraws the cable and the step up pin from the nut body end of the connector body 12 and turns over the connector body 12 to insert the cable and pin into the compression ring end of the connector body 12 as shown in FIGS. 9C and 9D. The step up pin 14 and the dielectric sleeve 44 are inserted into the axial bore of the inner post 26 such that the shaft 30 is forced in between the dielectric sleeve 44 and the outer conductor 46 as shown in FIG. 9E. The user continues to direct the cable 40 into the connector body 12 until the sloped surface 54 of the cable guide 34 engages the complementary sloped recess 56 of the pin guide 28 as shown in FIG. 9F. A compression tool (not shown) forces the compression ring 24 into the collar 22 such that the compression ring 24 compresses the jacket 48 and the outer conductor 46 against the shaft 30 to secure the cable 40 within the connector 10 and to provide good conduction between the outer conductor 46 and the inner post 26.

Figure 10A:
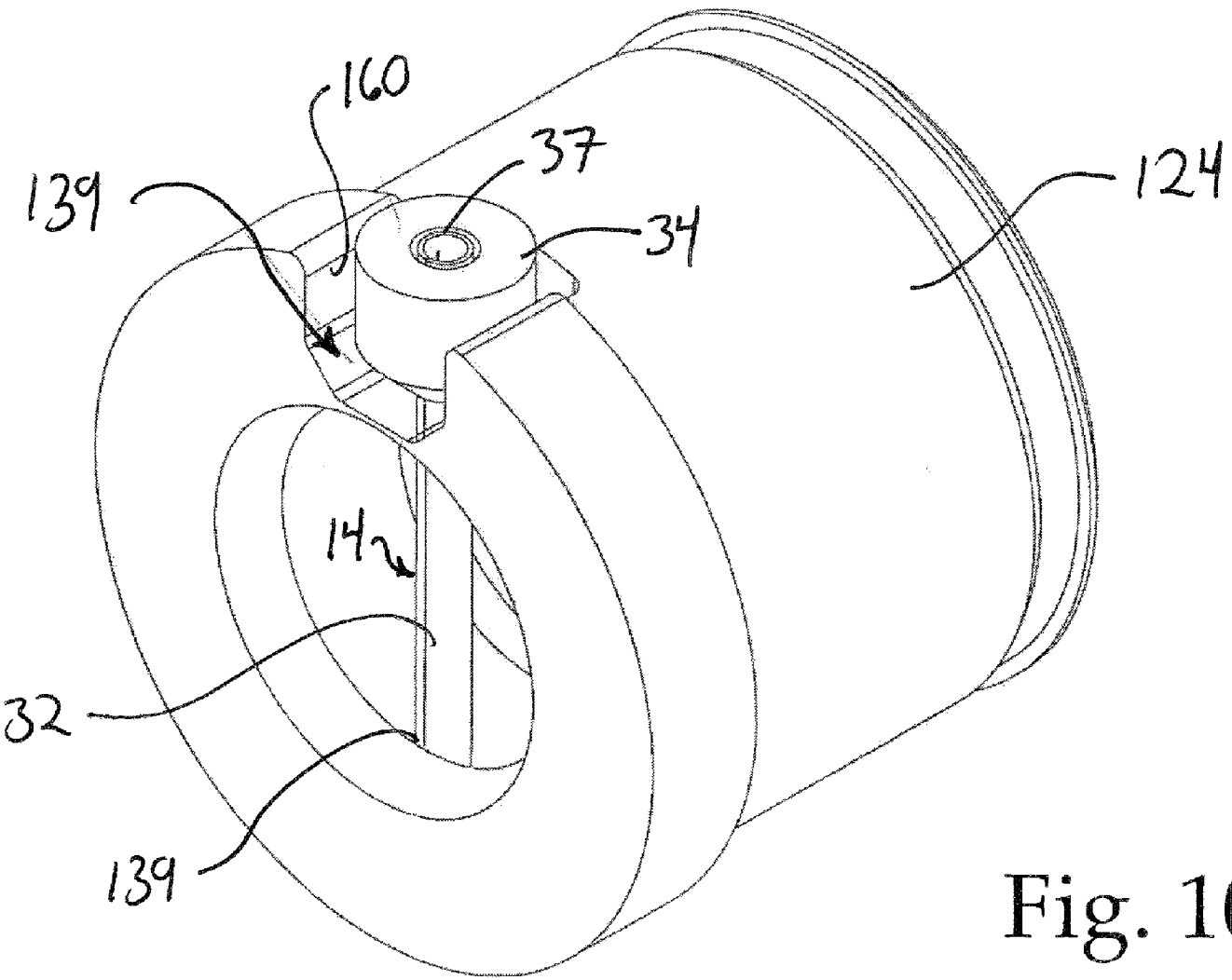
FIGS. 10A-10C are views of a particular embodiment of the coax cable connector with the step up pin stored in engagement with a countersunk sidewall bore in the compression ring.
Figure 10B:
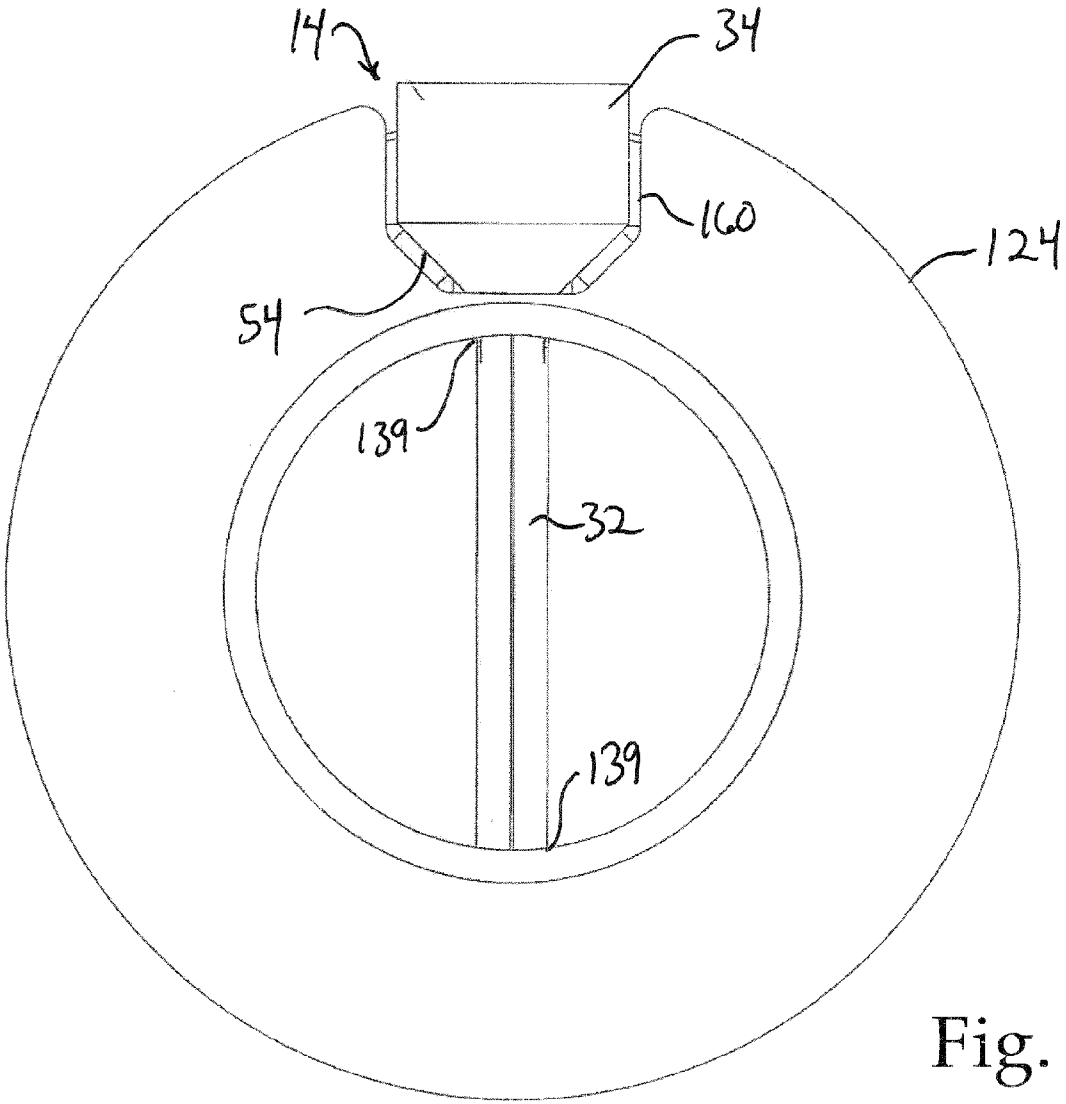
Figure 10C:
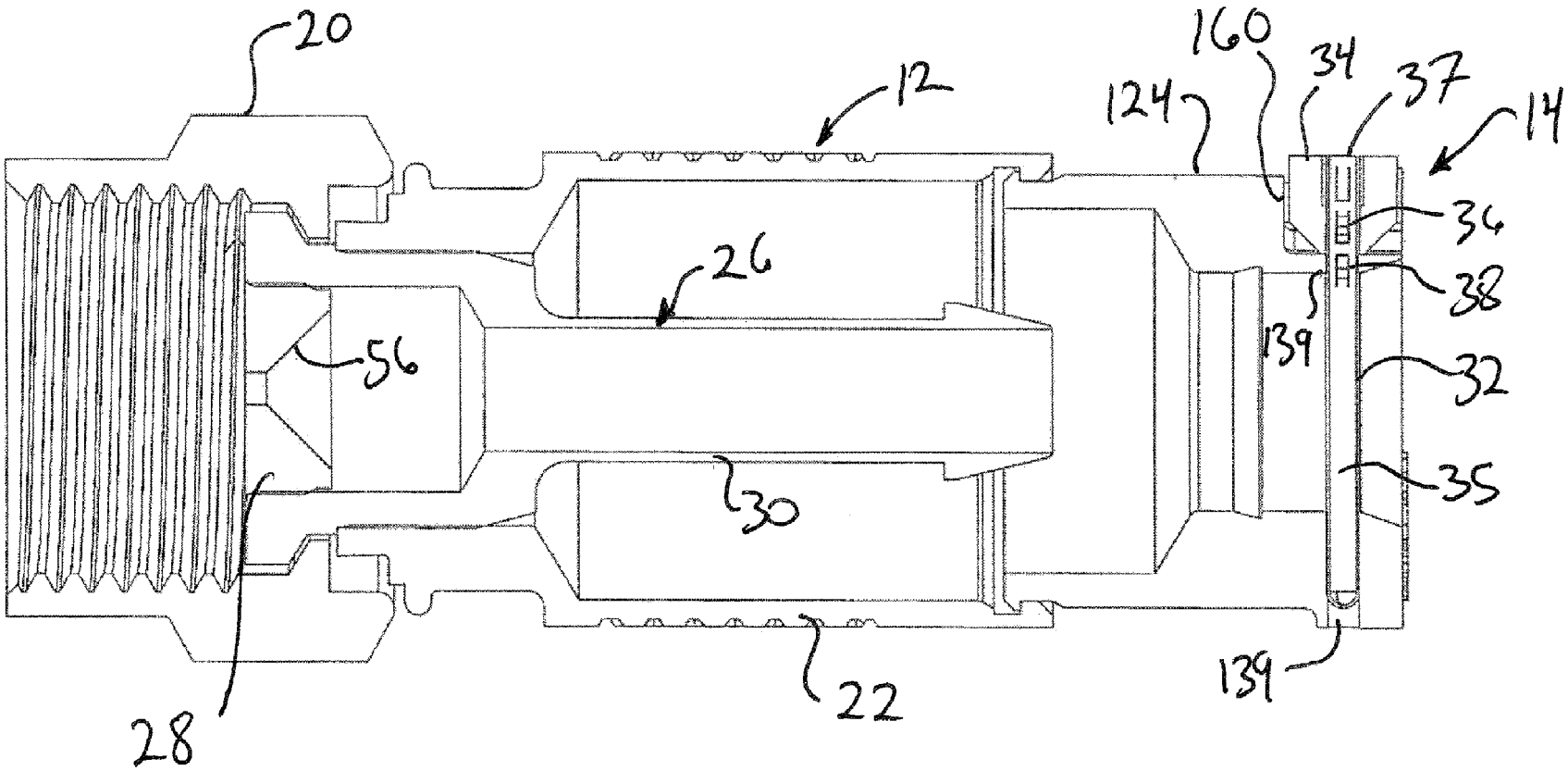

In a further particular embodiment shown in FIGS. 10A-10C, the step up pin 14 stored in engagement with a sidewall bore of the compression ring, similarly to that described above in relation to FIGS. 1, 2, 4A, and 4B. In the embodiment shown in FIGS. 10A-10C, however, the pin is stored in a countersunk sidewall bore 139 in the compression ring 124. The sidewall bore 139 includes an enlarged recessed portion 160 that receives the guide 34, and the bore 139 continues through at least a portion of the opposing side of the compression ring 124 to receive the end of the pin body 32. Thus, little of the step up pin 14 is exposed outside the compression ring 124 during storage and the pin is protected from damage during handling.

The connector 10 is assembled onto the prepared end of a coax cable. The user inserts the center conductor 42 into open end 37 of the axial blind bore 35, withdraws the cable 40 with the step up pin 14 from the sidewall bore 139, and inserts the cable 40 and step up pin 14 into the axial bore of the compression ring 24 as shown in FIG. 9D. The step up pin 14 and the dielectric sleeve 44 are inserted into the axial bore of the inner post 26 such that the shaft 30 is forced in between the dielectric sleeve 44 and the outer conductor 46 as shown in FIG. 9E. The user continues to direct the cable 40 into the connector body 12 until the sloped surface 54 of the cable guide 34 engages the complementary sloped recess 56 of the pin guide 28 as shown in FIG. 9F. A compression tool (not shown) forces the compression ring 24 into the collar 22 such that the compression ring 24 compresses the jacket 48 and the outer conductor 46 against the shaft 30 to secure the cable 40 within the connector 10 and to provide good conduction between the outer conductor 46 and the inner post 26.

It should be particularly noted that the step up pin 14 may have alternative shapes with respect to the cylindrical shape shown. Further, the pin 14 shown in the figures increases the diameter of the center conductor slightly; however, larger increases may be required and are considered within the scope of the invention.

While the invention has been described with reference to preferred embodiments, it will be understood by those skilled in the art that various changes may be made and equivalents may be substituted for elements thereof to adapt to particular situations without departing from the scope of the invention. Therefore, it is intended that the invention not be limited to the particular embodiments disclosed as the best mode contemplated for carrying out this invention, but that the invention will include all embodiments falling within the scope and spirit of the appended claims.

Parts List

10 connector
12 connector body
14 step up pin
20 nut body
22 collar
24 compression ring
26 inner post
27 o-ring
28 pin guide
30 shaft
32 pin body
34 cable guide
35 axial bore of pin body
36 spring fingers
37 open end of pin body
38 tabs
39 sidewall bore of compression ring
40 coax cable
42 central conductor
44 dielectric sleeve
46 outer conductor
48 jacket
50 sprue tabs
52 sprue tabs
54 sloped surface of cable guide
56 sloped recess of pin guide
124 alternate compression ring with countersunk sidewall bore
139 countersunk sidewall bore
160 recessed portion of the countersunk sidewall bore

The invention claimed is:

1. A coaxial cable connector, comprising:

a connector body having an axial bore therethrough;

a nut body engaging one end of the connector body;

a non-conducting pin guide situated within the connector body axial bore proximate to the junction between the nut body and the connector body, the pin guide having a pin guide bore; and a step up pin comprising a pin body and a cable guide, the step up pin having a pin body bore, the pin body and the cable guide being removably engaged with the pin guide.

2. The coaxial cable connector of claim 1, wherein the cable guide is situated within the nut body and the pin body includes a closed end that is directed into the axial bore of the connector body.

3. The coaxial cable connector of claim 1, the pin body bore having an opening situated within the nut body.

4. The coaxial cable connector of claim 1, the pin body being press-fit into the pin guide bore.

5. The coaxial cable connector of claim 1, the cable guide being affixed to the pin body with an adhesive.

6. The coaxial cable connector of claim 1, the pin guide being supported by an inner post engaging the nut body and the connector body.

7. The coaxial cable connector of claim 6, the inner post having a shaft for engaging an outer conductor of a coaxial cable.

8. The coaxial cable connector of claim 7, the pin guide defining a sloped recess facing away from the nut body, and the cable guide having a sloped surface that is complementary to the sloped recess of the pin guide.

9. The coaxial cable connector of claim 1, the step up pin comprising a spring finger projecting into the pin body bore.

10. The coaxial cable connector of claim 1, the step up pin comprising a pair of spring tabs projecting out from the step up pin.

11. A coaxial cable connector for mounting to a coaxial cable having a center conductor, comprising:

a connector body defining an axial bore;

a compressor ring defining an outer sidewall, the outer sidewall having a recessed portion and a recessed bore, the compressor ring operatively attached to the connector body; and a step up pin comprising a cable guide and a pin body, the pin body having a pin body bore for engaging the center conductor of the coaxial cable, whereby the pin body and the cable guide are removably engaged within the recessed bore and the recessed portion of the outer sidewall, respectively, in a first position and the pin body and the cable guide are movable to a second position within the axial bore of the connector body.

12. The coaxial cable connector of claim 11, the recessed bore extending through the compressor ring whereby the step up pin engages the recessed bore proximate to both ends of the step up pin.

13. The coaxial cable connector of claim 11, wherein the cable guide is affixed to the pin body with an adhesive.

14. The coaxial cable connector of claim 11, further comprising a nut body rotatably attached to an end of the connector body.

15. The coaxial cable connector of claim 14, further comprising an inner post for engaging an outer conductor of a coaxial cable, the inner post engaging the nut body.

16. The coaxial cable connector of claim 15, the inner post engaging a non-conducting pin guide that defines a sloped recess on one side thereof.

17. The coaxial cable connector of claim 16, the cable guide having a sloped surface for mating with the sloped recess of the pin guide.

18. The coaxial cable connector of claim 11, the step up pin comprising a spring finger projecting into the pin body bore.

19. The coaxial cable connector of claim 11, the step up pin comprising a pair of spring tabs projecting out from the step up pin.

* * * * *